United States Patent [19]

Ballin

[11] Patent Number: 4,815,440

[45] Date of Patent: Mar. 28, 1989

[54] APPARATUS FOR HEATING A BATH

[76] Inventor: Claude Ballin, Rue Belaitre, Quevillon Saint Martin, 76000 Boscherville, France

[21] Appl. No.: 9,539

[22] Filed: Feb. 2, 1987

[51] Int. Cl.[4] ..... F24H 1/20

[52] U.S. Cl. ..... 126/360 R; 219/317; 126/350 R

[58] Field of Search ..... 126/373, 378, 390, 391, 126/361, 362, 365, 366, 367, 360 R; 219/317; 4/493, 498

[56] References Cited

U.S. PATENT DOCUMENTS

| | | | |
|---|---|---|---|
| 1,193,740 | 8/1916 | Townsend | 126/360 R |
| 1,249,343 | 12/1917 | Dalton | 126/360 R |
| 1,259,059 | 3/1918 | Waterbury | 126/360 R |
| 2,124,186 | 7/1938 | Childs | 126/390 X |
| 2,185,594 | 1/1940 | Kittel | 126/376 X |
| 2,376,537 | 5/1945 | Hall | 126/361 |
| 2,465,953 | 3/1949 | Wollner | 126/391 |
| 2,543,835 | 3/1951 | Dewey | 126/391 |
| 2,561,932 | 7/1951 | Landgraf | 126/360 R |
| 2,593,392 | 4/1952 | Budlone et al. | 126/391 X |
| 2,655,144 | 10/1953 | Kealing | 126/391 |
| 2,756,321 | 7/1956 | Pappas | 126/391 X |
| 3,060,921 | 10/1962 | Luring et al. | 126/350 R |
| 3,194,229 | 7/1965 | Borgeson | 126/360 R |
| 4,289,111 | 9/1981 | Duncan et al. | 126/391 |
| 4,489,708 | 12/1984 | Yamamoto et al. | 126/362 |
| 4,552,123 | 11/1985 | Birkner et al. | 126/391 |
| 4,603,622 | 8/1986 | Beck | 126/391 |

*Primary Examiner*—Randall L. Green

*Attorney, Agent, or Firm*—Wolf, Greenfield & Sacks

[57] ABSTRACT

An apparatus for heating a bath comprises a cover whose underneath surface is intended to come into contact with the surface of the bath and comprises at least one passage which is open towards the bath. A heating means is operable in the passage thereby to heat the surface of the bath.

2 Claims, 1 Drawing Sheet

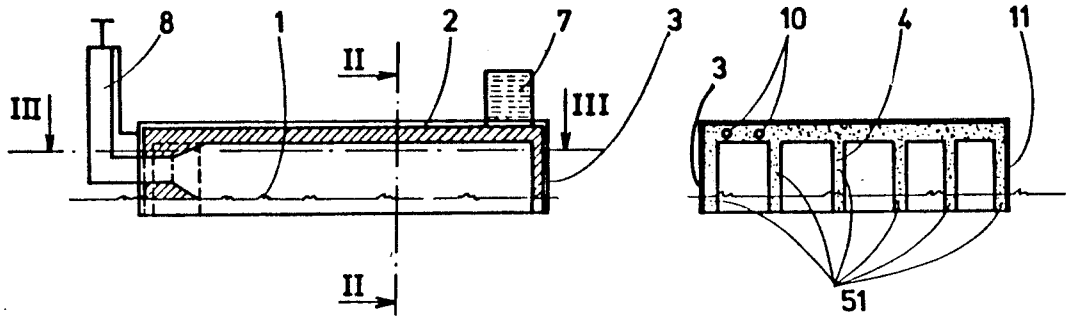
Fig. 1
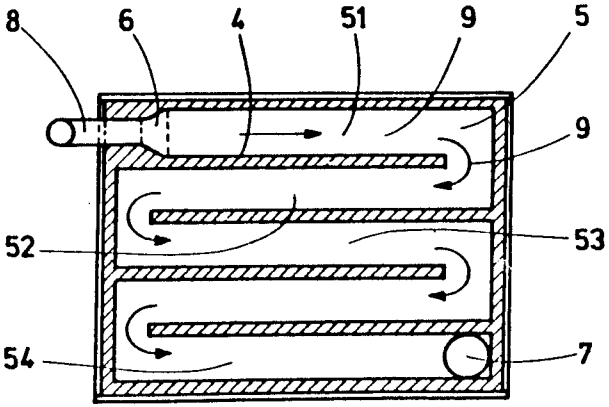
Fig. 2
Fig. 3

APPARATUS FOR HEATING A BATH

BACKGROUND OF THE INVENTION

The present invention generally concerns an apparatus for heating a bath such as a galvanisation bath.

At the present time, processing baths such as galvanisation baths are frequently heated by a system which heats the crucible in which the bath is contained. However that method of heating the bath is fairly delicate to control. Another method of heating a galvanisation bath comprises disposing over the bath an arch structure consisting for example of brichwork, which is heated and which thus be radiation heats the bath and holds it at the appropriate temperature. Although that method of heating the bath is a more attractive proposition than the method which involves heating the crucible, it only has a relatively low level of effectiveness and it limits accessibility of the bath.

Another method of heating such a bath involves immersing therein heating elements of refractory material, in the form of pots, within which are disposed gas burners or electrical heating elements. The improvement in the level of effectiveness provided by that construction is an interesting proposition in particular when using electrical heating means. When using gas burners, the circulation of the hot gases in the pots gives rise to relatively substantial losses which reduce the effectiveness of the heating operation involving direct contact with the bath.

In addition the above-indicated heating arrangement using heating pots which are immersed in the bath suffer from the not inconsiderable disadvantage that they constitute a bulky structure which is immersed in the bath. In fact, the conductivity of the wall of refractory material of the pots limits the output power that each pot can provide. Therefore, the number of pots has to be multiplied, depending on the volume of the bath, the nature thereof and the temperature involved. Multiplying the pots in that way clutters up the bath and interferes with the positioning of various items of equipment.

SUMMARY OF THE INVENTION

An object of the present invention is to provide an apparatus for heating a bath which does not suffer from the above-indicated disadvantages.

Another object of the present invention is to provide an arrangement for heating a bath such as a galvanisation bath, which provides for highly effective heating with a high level of output.

Another object of the present invention is to provide a bath heating apparatus which is simple to use while being highly flexible in operation as well as leaving the bath accessible from all sides thereof.

In accordance with the present invention, these and other objects are achieved by an apparatus for heating a bath such as a galvanisation bath, which comprises a cover whose downwardly facing surface is intended to come substantially into contact with the surface of the bath. The surface of the cover comprises at least one passage or channel which is open towards the bath. The apparatus further includes a heating means which opens into or is operable in the channel or passage, thereby to heat the surface of the bath.

The heating apparatus according to the invention can thus be placed on the bath and float at the surface thereof. The bath thus defines the channel or passage in the cover, in the lower part thereof, thereby producing a volume for direct heating of the bath in part by conduction and in part by radiation. In an advantageous embodiment, the heating means is an electrical heating means disposed in the passage or channel. In that case, the atmosphere in the passage or channel remains the same since there is no circulation of gas or air in the passage, except for the circulatin currents resulting from the convection effect.

In another embodiment, the heating means may be a burner which opens into the passage at the entrance thereof. In that case, gas circulates through the passage. The flow of gas through the passage is thus in contact with the surface of the bath and provides for heating thereof at least in part, the supplementary part of the heating effect being provided by radiation from the walls of the passage. At the outlet from the passage, the fumes and smoke are recovered by a discharge conduit connected to the outlet of the passage.

That construction, by regulation of the fuel mixture, makes it possible to provide a reducing atmosphere at the surface of the bath, and that may be an attractive proposition in particular in the case of a galvanisation bath.

In particularly advantageous embodiment, the cover comprises only a single channel or passage which extends in a meander-like configuration, thereby preferably occupying virtually the whole of the surface of the cover. It is also possible however for the cover to comprise a plurality of channels or passages, with one or more heating means or units per passage. Particularly when using gas burners as the heating means, it may be an attractive proposition to provide a separate feed for each of the passages in the cover and to dispose the points or tips of the gas burners at locations spaced from the cover in such a way that circulation of the hot gases in the passages occurs so-to-speak in counter-flow mode, thereby homogenising the temperature of the gases in the passages and consequently the temperature of the bath. It should be noted however that particularly when dealing with a galvanisation bath, the heat exchange effect is excellent by virtue of the above-indicated direct contact and the very nature of the bath avoids temperature differences within the bath as convection currents and conduction in the bath ensure that the bath temperature is substantially uniform.

In a particularly advantageous structure, the cover and partitioning wall means on the cover which define the passage or passages are generally made of refractory material or materials because the cover and partitioning wall means are in contact with the metallic bath and because the flame of the burner partially projects into the passage of the cover. The cover is advantageously provided on the outside with an insulating layer to avoid heat losses. The cover of that structure generally has the dual advantage of providing for direct heating of the bath by contact between the heating means or the hot air and the surface of the bath. The cover also has the advantage of insulating a substantial part of the surface of the bath and preventing heat losses at that location.

In accordance with a further feature of the invention, the cover is at least partially of a double-wall construction that is, a hollow structure in order to provide a path for circulation of the air for feeding the burner. That permits the combustion gases to be preheated.

The sizes of the cover, its surface area or the division of the cover into a plurality of separate components or multiplication of the covers at the surface of the bath, depend on the operating conditions involved. It should be observed however that covers floating at the surface of the bath do not require a support means and the only obstruction that they produce is that due to the feed means for the heating means and, if appropriate, the conduit system for discharge of smoke and fumes. However, such means may be disposed vertically in line with and thus within the outside perimeter of the cover. In that way there is free access to the bath over the whole of the perimeter of the crucible, which is a not inconsiderable advantage.

Moreover, as indicated above, the atmosphere in the heating chamber defined by the passage in the cover may be a reducing atmosphere, which avoids oxidation of the galvanisation bath (of zinc) and the formation of layers floating at the surface of the bath, as occurs when using arch structure. There is therefore no insulating layer between the bath in the true sense and the heating cover structure. In that way the surface of the bath permits excellent heat exchange to be achieved between the heating means and the bath.

Further objects, features and advantages of the present invention will be apparent from the following description of a preferred embodiment thereof.

BRIEF DESCRIPTION OF THE DRAWING

FIG. 1 is a view in vertical section of an embodiment of a heating apparatus according to the principles of this invention, FIG. 2 is a view in cross-section taken along line II—II in FIG. 1, and FIG. 3 is a view in horizontal section of the apparatus shown in FIG. 1 taken along line III—III therein.

DESCRIPTION OF THE PREFERRED EMBODIMENT

Referring now to the drawings, reference numeral 1 in FIGS. 1 and 2 represents the surface of a treatment bath such as a galvanisation bath which is to be heated. The remainder of the bath is therefore not shown, for the sake of simplicity of the drawing. The apparatus for heating the bath comprises a cover 2 which is provided with peripheral walls as indicated at 3 and intermediate partitioning wall portions 4 which are not continuous from one end of the cover 2 to the other, to form a channel or passage 5 extending from an intake 6 to an outlet 7 of the cover 2. The configuration of the passage 5 can be clearly seen from FIG. 3 which shows that in this embodiment the passage 5 is of a meander-like configuration.

The passage 5 receives a heating means such as an electrical heating means or a gas heating means. The electrical heating means is formed by an array of resistance heaters which are distributed in the passage 5. As, in that case, there is no circulation of smoke or fumes or combustion gas, the inlet 6 and the outlet 7 are closed. When using a gas burner as indicated at 8 in FIGS. 1 and 3, gases therefrom circulate in the direction indicated by the arrows 9 in FIG. 3, between the intake 6 and the smoke and fume outlet 7. FIG. 3 thus shows the way in which the smoke and fumes from the burner 8 follow the meandering configuration of the passage 5.

Regulation of the fuel mixture feeding the burner 8 makes it possible to produce a reducing atmosphere in the passage 5 which thus forms a heating chamber, and such an atmosphere may be an attractive proposition when the heating apparatus is to be used in relation to a galvanisation bath using zinc. The use of the illustrated heating apparatus prevents oxidation of the bath and the formation of an insulating crust at the surface 1 thereof.

Referring now to FIG. 2, it will be seen that ducts or conduits 10 are also provided in the body of the cover 2. The conduits 10 provide a feed of fuel or combustion air and permit preheating of the combustion air, in particular in line with the portion 51 of the passage 5, into which the burner 8 opens and which is at the highest temperature due to its proximity to the burner.

The cover 2 is also provided with a thermal insulating outside layer as indicated at 11 in FIG. 2.

Although, in the embodiment illustrated in FIGS. 1 through 3, the heating chamber or passage 5 is formed only by a single passage, the heating chamber may be formed by a plurality of passages or channels in parallel relationship, with the combustion gases flowing in the same direction or in opposite directions therein.

It should also be noted that in a construction where the cover has an electrical heating means operable to produce its heating effect within the passage, the partitioning wall portions 4 may extend from one end of the cover 2 to the other and thereby define portions 51, 52, 53, and 54 which are separate from each other.

Although generally the system involves a single heating apparatus, it may also be an attractive proposition to subdivide the heating system into a plurality of units which are all the same as the heating apparatus described hereinbefore with reference to FIGS. 1 through 3. It should also be noted that, by virtue of the contact between the gases and the surface of the bath, the temperature of the gases issuing by way of the discharge conduit connected to the outlet 7 is equal to the temperature of the bath. It is possible to exhaust those gases and to reduce the temperature thereof (which in certain cases may be of the order of 400° C.), by means of a heating coil (not shown) which is disposed around the outlet 7 and which serves for preheating the combustion gases.

Finally, depending on the uses involved, the combustion gases may also be used for heating other parts of the installation.

The cover is preferably made of a refractory material which cannot be atacked by the bath, in particular zinc when dealing with a galvanisation bath, and which has a substantial level of insulating and reflecting capability and which is either of low density or of a density compatible with the density of the bath, to provide that the cover satisfactorily floats on the bath.

It will be appreciated that the above-described structure has been set forth solely by way of example of the principles of the present invention and that various modifications and alterations may be made therein without thereby departing from the spirit and scope of the invention.

I claim:

1. Apparatus for heating a processing bath comprising a cover means adapted to float at the surface of a said bath to be heated, means on the surface of said cover means which in use is towards said bath to be heated, adapted to define passage means which is open towards the surface of said bath to be heated, a heating means adapted to produce an increased temperature within said passage means, thereby to heat the surface of said bath, wherein said cover means comprises outside wall means and partitioning wall means defining said at least one passage and comprises a refractory material, and wherein the outside of said surface cover means is provided with insulating means.

2. Apparatus for heating a processing bath comprising a cover means adapted to a float at the surface of a said bath to be heated, means on the surface of said cover means which in use is towards said bath to be heated, adapted to define passage means which is open towards the surface of said bath to be heated, a heating means adapted to produce an increased temperature within said passage means, thereby to heat the surface of said bath and wherein said cover means is at least partially of a double-wall structure forming a circulation path for preheating of the combustion air feeding said burner.

* * * * *